US009540148B2

(12) United States Patent
Fournier et al.

(10) Patent No.: US 9,540,148 B2
(45) Date of Patent: Jan. 10, 2017

(54) LIGHTWEIGHT SINGLE-DOSE CONTAINER

(75) Inventors: Dominic Fournier, St. Eugene (CA); Michel Brunet, Lancaster (CA)

(73) Assignee: MONFITELLO INC., Lachine Quebec (CA)

( * ) Notice: Subject to any disclaimer, the term of this patent is extended or adjusted under 35 U.S.C. 154(b) by 80 days.

(21) Appl. No.: 12/714,186

(22) Filed: Feb. 26, 2010

(65) Prior Publication Data

US 2011/0210145 A1 Sep. 1, 2011

(51) Int. Cl.

| | |
|---|---|
| ***B65D 35/00*** | (2006.01) |
| ***B65D 37/00*** | (2006.01) |
| ***B65D 35/06*** | (2006.01) |
| ***B65D 35/08*** | (2006.01) |
| *B65D 53/08* | (2006.01) |

(52) U.S. Cl.

CPC ..... *B65D 35/06* (2013.01); *B65D 35/08* (2013.01); *B65D 53/08* (2013.01)

(58) Field of Classification Search

CPC ..... B65D 38/08; B65D 35/06; B29D 23/20; B29L 2023/20

USPC ..... 222/92, 107, 215, 153.05, 153.07, 541.1

See application file for complete search history.

(56) References Cited

U.S. PATENT DOCUMENTS

| | | | | |
|---|---|---|---|---|
| 1,941,929 | A * | 1/1934 | Burdick | 222/153.05 |
| 2,125,250 | A * | 7/1938 | Temple | 222/92 |
| 2,146,921 | A * | 2/1939 | Temple | 222/541.2 |
| 2,147,349 | A | 2/1939 | Piquerez | |
| 2,159,714 | A * | 5/1939 | Serog | 222/541.1 |
| 4,017,020 | A * | 4/1977 | Frank | 383/42 |
| 5,094,357 | A * | 3/1992 | McKinney | 220/214 |
| 5,174,458 | A * | 12/1992 | Segati | 215/383 |
| 5,209,795 | A | 5/1993 | DeRosa et al. | |
| 5,219,086 | A * | 6/1993 | Bjorck | 220/270 |
| 5,340,421 | A | 8/1994 | Shea et al. | |
| 5,383,577 | A * | 1/1995 | Prahs | 222/107 |
| 7,007,823 | B2 * | 3/2006 | Jackson | 222/99 |
| 7,051,892 | B1 * | 5/2006 | O'Day, Jr. | 215/383 |
| 7,128,241 | B2 * | 10/2006 | Leung | 222/1 |
| 7,810,680 | B2 * | 10/2010 | Stull et al. | 222/541.9 |
| 2005/0121465 | A1 * | 6/2005 | Miranda | 222/92 |
| 2006/0188676 | A1 * | 8/2006 | Dambricourt | 428/35.2 |
| 2007/0131713 | A1 | 6/2007 | Hill | |
| 2007/0187430 | A1 * | 8/2007 | Chen | 222/105 |
| 2009/0095369 | A1 * | 4/2009 | Murray | 141/5 |
| 2009/0166380 | A1 | 7/2009 | Leblais | |

* cited by examiner

*Primary Examiner* — Patrick M Buechner
*Assistant Examiner* — Jeremy W Carroll
(74) *Attorney, Agent, or Firm* — Schwabe, Williamson & Wyatt, P.C.

(57) ABSTRACT

A single-dose container for storing and dispensing products, the container comprises a flexible body defining an interior cavity and having an end sealable by joining a first inner side of the inner surface of the body to an opposite inner side of the inner surface of the body, a second end of the body having a shoulder and a protuberance with the protuberance defining a dispensing orifice and having a sealing edge, a seal membrane shaped to overlie the sealing edge and to cover the dispensing orifice, a tab portion extending from the seal membrane, and wherein the seal membrane is removable affixed to the sealing edge.

25 Claims, 4 Drawing Sheets

LIGHTWEIGHT SINGLE-DOSE CONTAINER

FIELD OF THE INVENTION

This invention relates to the general field of containers, in particular to single-use or single-dose containers that are designed to store and dispense the product within.

BACKGROUND OF THE INVENTION

Single-dose containers are common in everyday life, such as in the food and beverage, cosmetic, pharmaceutical and other industries.

Examples of single-dose containers include sachets, tetra-packs, pouches, PET/plastic cups or glass vial bottles, which have their limitations. Sachets do not have dispensing orifices, making them difficult to use. In addition, sachets often need to be torn open, which can cause an additional challenge when dispensing a product. Tetra-packs are used in the beverage industry and can hold liquids, but require a straw to consume. They are not appropriate for other types of products, such as creams, pastes, ointments and other viscous products that need to be easily dispensed from the container. Pouches are similar to sachets in that they must be torn open and lack clean and convenient dispensing orifices, which can lead to a mess. PET/plastic cups often require an additional tool or apparatus to obtain the product contained in the plastic cup. Glass vial bottles are breakable and heavier in weight, and cannot be used effectively for viscous or pasty products as such products cannot be dispensed easily by gravity or squeezing.

The majority of known single-dose containers have a cap closure or lid placed over an open end of the container or some type of seal to cover the open end. Many of these known containers have upwardly extending threaded necks to receive a cap, and may also have a sealing edge at the end of the neck to hold a seal to cover the open end. Those containers with a seal often require an apparatus to puncture the seal, such as a pointed end on the inside of the cap. Tear off seals have also been used, but such seals can be difficult to use.

SUMMARY OF THE INVENTION

The embodiments of the present invention relate to a single-dose container for storing and dispensing products.

One embodiment of the single-dose container relates to a container that is lightweight and easy to open. The container comprises a flexible body defining an interior cavity, with the flexible body being collapsible such that the product contained within the body can be dispensed from the container. The flexible body has one end that is sealable by joining the inner sides of the inner surface of the body. The second end of the flexible body is defined by a shoulder and a protuberance. The protuberance defines a dispensing orifice and has a sealing edge. The dispensing orifice is closed off by a seal membrane that overlies the sealing edge of the protuberance. A tab portion extends from the sealing edge and is bent and folded back over the seal membrane such that the tab portion extends substantially parallel to the plane of the seal membrane. The seal membrane is affixed to the sealing edge, and can easily be peeled away from the sealing edge by a user by pulling on the tab portion.

According to one aspect, the single-dose container is disposable.

According to one aspect, the product contained in the single-dose container is fluid, that is, powdery or liquid to pasty.

According to one aspect, the product contained in the single-dose container is a liquid. Alternatively, the product is a concentrated drink, a paste, a cream, an ointment, a powder or a granular product.

According to another aspect, the single-dose container entirely dispenses the product contained in the container.

According to one aspect, the tab portion of the single-dose container is integral with the seal membrane.

According to one aspect, the seal membrane is peelable from the sealing edge of the single-dose container.

According to one aspect, the flexible body is made of a material selected from the group consisting of metal alloys, such as aluminum, laminate, plastic barrier laminated materials or ethylene vinyl alcohol.

According to another aspect, the shoulder and protuberance are made of a polymer compound, such as polyethylene or polypropylene.

According to another aspect, the seal membrane is made of a thin material, such as aluminum foil.

According to another aspect, the dispensing orifice is between about 20% and 35% of the surface of the shoulder. Alternatively, the dispensing orifice is between about 5% and 65% of the surface of the shoulder.

BRIEF DESCRIPTION OF THE DRAWINGS

Embodiments of the present invention will be described with reference to the following drawings, in which like reference numerals denote like parts.

DETAILED DESCRIPTION OF THE INVENTION

The embodiments of the present invention relate to a single-dose container for storing and dispensing products. The products contained in the single-dose container are fluid; i.e. powdery or liquid to pasty, such as liquids, pastes, creams, ointments, powder or granular products as well as various other substances. Examples of such products include concentrated drinks, sunscreen, polysporin ointment, toothpaste, ketchup, mayonnaise, mustard, drink crystals, sugar and salt. The containers are versatile and can be used in the pharmaceutical, cosmetic, neutraceutical, homeopathy, natural health, food and beverage industries.

Figure 1:
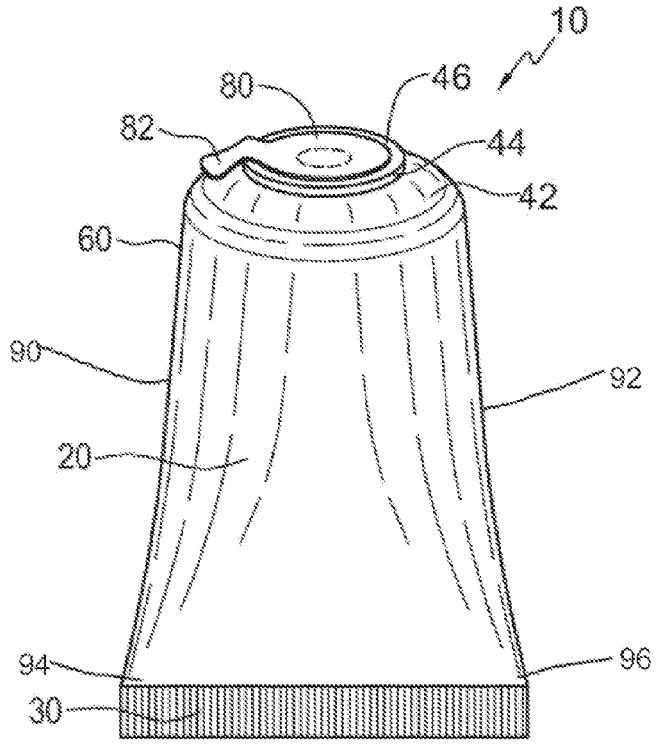
FIG. 1 is front view of the disposable container.

Referring to FIG. 1, a disposable container according to an embodiment of the present invention is indicated by reference numeral 10. Flexible body 20 of container 10 is made of a collapsible material such that the product contained within flexible body 20 can be entirely dispensed.

The material for flexible body 20 can be any type of flexible, collapsible material of varying thickness, such as aluminum. Other materials that can be used include other formable metal alloys, various laminate materials, ethylene vinyl alcohol ("EVOH") or plastic barrier laminated ("PBL") materials. The material for flexible body 20 can be sterilized for use with products that need to be sterile. Since various materials can be used to manufacture container 10, container 10 can be hot-filled, cold-filled, dry-filled and/or sterilized for aseptic filling.

Disposable container 10 has first end 30 that is sealed by joining the inner sides of the inner surfaces of flexible body 20 using techniques known in the art, such as hot air, hot jaws, high frequency welding or ultrasonic sealing. Sealing first end 30 in this way shapes container 10 into the form of a flexible skirt, which under the pressure exerted by the fingers of the hand, can be squeezed so the product contained inside said skirt can be pushed out.

Second end 40 has protuberance 44 with sealing edge 46 that is generally flat (not shown in FIG. 1) upon which container 10 can rest in a standing position.

First end 30 and second end 40 are on opposite ends of body 10 along longitudinal axis 50. Body 20 additionally includes a first side wall 90 and a second side wall 92, defining an interior cavity sealable at the first end 30 by joining a first inner side 94 of the first side wall, said first inner side being the inner surface of said body, to an opposite inner side 96 of the second side wall, said opposite inner side being the inner surface of said body.

Figure 2:
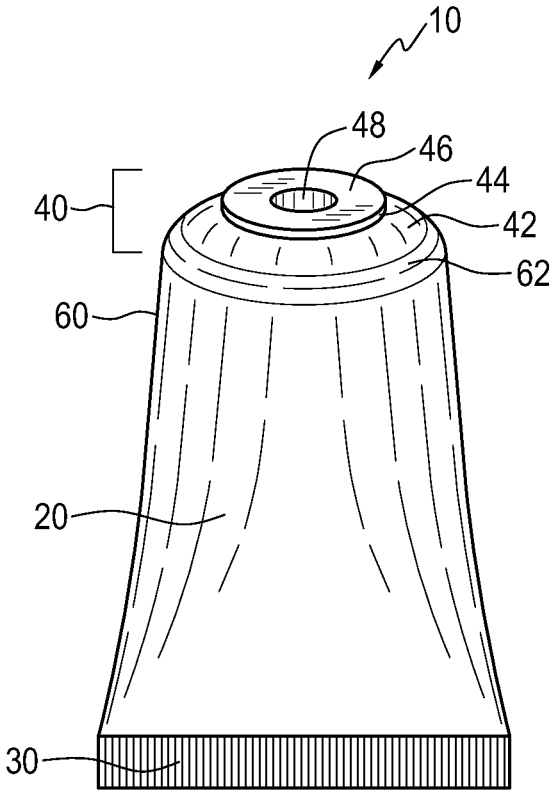
FIG. 2 is a perspective view of the disposable container.
Figure 5:
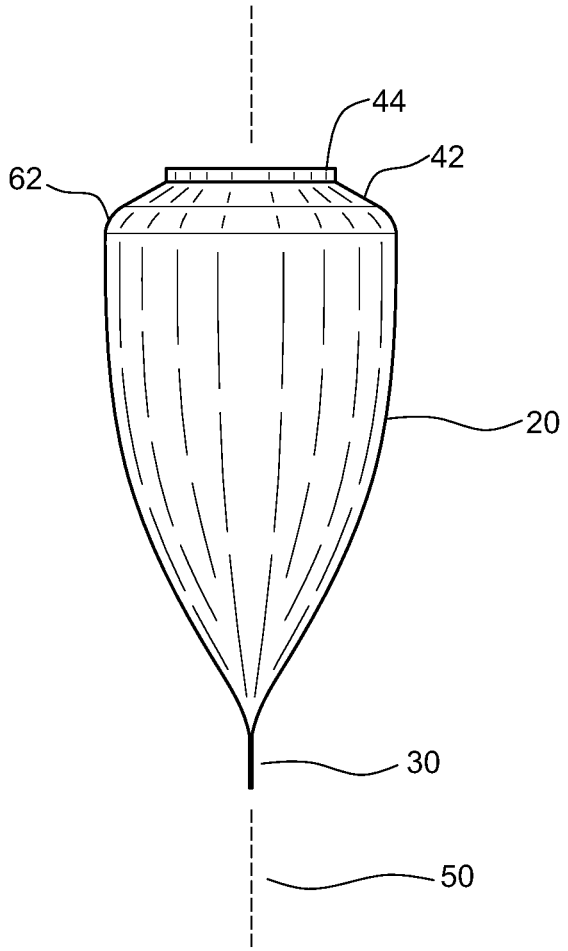
FIG. 5 is a side view of the disposable container.

Referring to FIGS. 2 and 5, second end 40 has shoulder 42 and protuberance 44. Second end 40 contains no neck that extends from shoulder 42. Shoulder 42 and protuberance 44 are contiguous with each other. Protuberance 44 defines dispensing orifice 48 and has sealing edge 46. Dispensing orifice 48 is positioned in approximately the centre of protuberance 44 and sealing edge 46 defines the outer ring of dispensing orifice 48 contained in approximately the centre of protuberance 44. Dispensing orifice 48 is represented as a circle, but may also be a slit, square, diamond, rectangle or other shaped opening.

Shoulder 42 connects second end 40 to flexible body 20 of container 10. For esthetic and practical reasons, side wall 60 of flexible body 20 may be flush with shoulder 42 of second end 40. In other words, side wall 60 is a continuation of the outer surface of shoulder 42. Second end 40 can be secured to flexible body 20 using methods known in the art, such as compression moulding or high frequency welding. Lip 62 indicates the point of attachment between side wall 60 and shoulder 42, with side wall 60 overlapping shoulder 42, which results in lip 62 being a rounded edge where flexible body 20 meets second end 40.

Referring to FIGS. 1 and 5, axis 50 is an axis of symmetry (rotational symmetry), such that protuberance 44 and sealing edge 46 encircle axis 50 and axis 50 passes approximately through the centre of dispensing orifice 48.

Second end 40 is one continuous piece of the same material and is semi-rigid. The material can be polyethylene, polypropylene or other polymer compound in clear or coloured form. Second end 40 can be formed into shoulder 42 and protuberance 44 using methods known in the art, such as compression moulding or injection moulding.

Shoulder 42 and protuberance 44 of container 10 can be made in various sizes and shapes depending on the product to be contained in container 10. Dispensing orifice 48 in the centre of protuberance 44 may also be of different sizes depending on the product.

Flexible body 20 typically has a greater dimension along axis 50 compared to the width of flexible body 20. Flexible body 20 is symmetrical in relation to a plane passing through axis 50. Second end 40 has a height between lip 62 and sealing edge 40 that is no greater than 0.5 cm and represents approximately 0.03% to approximately 1.0% of the length of container 10 along axis 50.

Shoulder 42 of the opposing end is set at approximately a 60° angle in relation to a line parallel to axis 50 and extending straight from side wall 60 of flexible body 20. Alternatively, shoulder 42 can be set at any angle between about 20% and about 70% in relation to a line parallel to axis 50 and extending straight from side wall 60 of flexible body 20. The height of protuberance 44 is generally between about 0.05 cm and about 0.25 cm.

Figure 3:
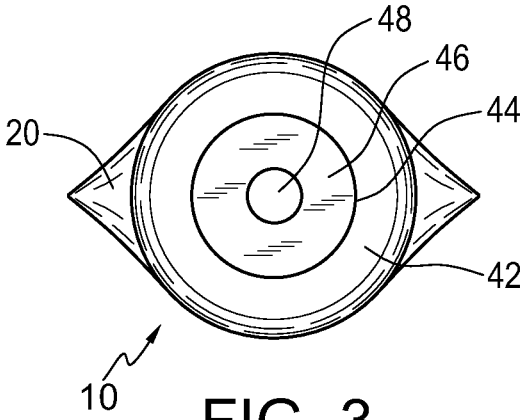
FIG. 3 is a top view of the disposable container wherein the tab portion is removed, illustrating the shoulder, protuberance and dispensing orifice of the disposable container.

FIG. 3 is a top view of container 10, without a seal membrane covering dispensing orifice 48. Dispensing orifice 48 is represented as a circle approximately in the centre of shoulder 42. Sealing edge 46 is represented as an inner ring enclosing dispensing orifice 48. Shoulder 42 is represented as an outer circle surrounding sealing edge 46. FIG. 3 is representative of the diameter of dispensing orifice 48 in relation to shoulder 42 and flexible body 20. In the embodiment shown in FIG. 3, the diameter of dispensing orifice 48 is about 25% of the surface of shoulder 42, but is more commonly between 20% and 35% and can be between 5% and 65% of the surface of shoulder 42.

Figure 4:
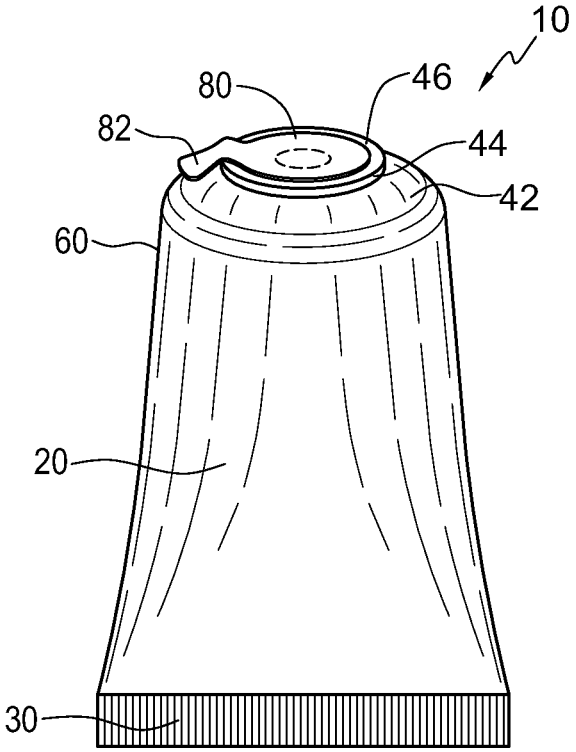
FIG. 4 is a perspective view of the disposable container, illustrating the seal membrane and tab portion of the disposable container.

FIG. 4 is a perspective view of second end 40, with seal membrane 80 overlaying sealing edge 46. Seal membrane 80 can be made of any thin material sealable to sealing edge 46, such as aluminum foil. Tab portion 82 extends from seal membrane 80. Tab portion 82 can be made in various lengths. Tab portion 82 is bent back and over against the top of seal membrane 80 so that it extends substantially parallel to the plane of seal membrane 82.

Seal membrane 80 is removably affixed to sealing edge 46, which prevents the product contained in container 10 from leaking before the user dispenses the product from container 10. Seal membrane 80 is removably affixed using methods known in the art, such as using heat or an adhesion compound. Seal membrane 80 can be removed by peeling seal membrane 80 away from sealing edge 46. The user can easily remove the seal membrane 80 from container 10 by pulling tab portion 82 away from seal membrane 80 and across the plane of seal membrane 80.

In an alternative embodiment, the tab portion can extend radially downward away from protuberance 44 and along shoulder 42 toward side wall 60 of flexible body 20.

The present invention is easy to use, quick and easy to open and dispenses the product contained in it quickly due to the flexible and collapsible wall of the flexible body. By eliminating the need for a threaded neck and cap closure, the disposable container described herein uses a minimum amount of raw materials, resulting in less environmental waste, a reduced weight for the disposable container and reduced costs in shipping the container and in manufacturing the container. The present invention is a versatile type of container that covers a wide range of application fields and a wide range of products.

The above-described embodiments have been provided as examples, for clarity in understanding the invention. A person of skill in the art will recognize that alterations, modifications and variations may be effected to the embodiments described above while remaining within the scope of the invention as defined by the claims appended hereto.

What is claimed is:

1. A container for storing and dispensing products, said container comprising:

a flexible body for dispensing a single dose of said product, said body having a first end and a second end and a first side wall and a second side wall, and defining an interior cavity sealable at the first end by joining a first inner side of the first side wall, said first inner side being the inner surface of said body, to an opposite inner side of the second side wall, said opposite inner side being the inner surface of said body;

said second end of the body being neckless and threadless and having a shoulder, a lip and a protuberance, said lip formed by an overlap of each of the first side wall and the second side wall at the shoulder, resulting in the lip forming a rounded edge; said protuberance defining a dispensing orifice and having a generally flat sealing edge, wherein said sealing edge defines an outer ring of the dispensing orifice;

a seal membrane shaped to overlie the sealing edge and to cover said dispensing orifice;

a tab portion extending from said seal membrane and extending radially downwardly away from the protuberance and along the shoulder;

wherein said seal membrane is removably affixed to said sealing edge;

wherein a cap is not provided at said second end to cover seal membrane;

wherein the protuberance is of insufficient height to accommodate threads;

wherein said dispensing orifice has a diameter between 5% and 65% of the total diameter of the surface of the shoulder, and said dispensing orifice has a diameter less than half a radius of said sealing edge, thereby providing with the sealing edge and seal membrane, a surface upon which said container can stand, upright; and wherein said container is single use.

2. The container according to claim 1 wherein said container is disposable.

3. The container according to claim 1 wherein said product is a fluid, which may be powdery or pasty.

4. The container according to claim 1 wherein said product is a liquid.

5. The container according to claim 1 wherein said product is a concentrated drink.

6. The container according to claim 1 wherein said product is a paste.

7. The container according to claim 1 wherein said product is a cream.

8. The container according to claim 1 wherein said product is an ointment.

9. The container according to claim 1 wherein said product is a powder.

10. The container according to claim 1 wherein said product is a granular product.

11. The container according to claim 1 wherein said container entirely dispenses the products contained in the container.

12. The container according to claim 1 wherein said tab portion is integral with said seal membrane.

13. The container according to claim 1 wherein said tab portion is bent back and over against the top of the seal membrane so said tab portion extends substantially parallel to the plane of the seal membrane.

14. The container according to claim 1 wherein said seal membrane is peelable from the sealing edge of the single-dose container.

15. The container according to claim 1 wherein said flexible body is made of a material selected from the group consisting of metal alloys, laminate, plastic barrier laminated materials or ethylene vinyl alcohol.

16. The container of claim 1 wherein the flexible body is made of aluminum.

17. The container according to claim 1 wherein said shoulder and protuberance are made of a polymer compound.

18. The container of claim 1 wherein said shoulder and protuberance are made of polyethylene.

19. The container of claim 1 wherein said shoulder and protuberance are made of polypropylene.

20. The container according to claim 1 wherein said seal membrane is comprised of a thin material.

21. The container of claim 1 wherein said seal membrane is comprised of aluminum foil.

22. The container according to claim 1 wherein said dispensing orifice has a diameter between 20% and 35% of the surface of the shoulder.

23. The container according to claim 1 wherein a height between the lip and the sealing edge is no greater than 0.5 cm.

24. The container according to claim 1 wherein a height between the lip and the sealing edge represents from 0.03% to 1.0% of an entire length of the container, through a centre axis.

25. The container according to claim 1 wherein the protuberance has a height of between 0.05 cm and 0.25 cm.

* * * * *